US005900892A

United States Patent [19]

Mantell et al.

[11] Patent Number: 5,900,892

[45] Date of Patent: May 4, 1999

[54] NOZZLE PLATES FOR INK JET CARTRIDGES

[75] Inventors: David A. Mantell; Lisa A. DeLouise; Cathie J. Burke, all of Rochester; Mildred Calistri-Yeh, Webster; Almon P. Fisher, Rochester; Narayan V. Deshpande, Penfield, all of N.Y.

[73] Assignee: Xerox Corporation, Stamford, Conn.

[21] Appl. No.: 08/811,624

[22] Filed: Mar. 5, 1997

[51] Int. Cl.[6] ..... B41J 2/16

[52] U.S. Cl. ..... 347/45; 347/47; 29/890.1

[58] Field of Search ..... 347/45, 47; 29/890.1

[56] References Cited

U.S. PATENT DOCUMENTS

| | | | |
|---|---|---|---|
| 4,285,754 | 8/1981 | DiMatteo | 156/264 |
| 4,774,530 | 9/1988 | Hawkins | 346/140 |
| 4,994,826 | 2/1991 | Tellier | 346/140 |
| 5,208,604 | 5/1994 | Watanabe et al. | 347/47 |
| 5,305,015 | 4/1994 | Schantz et al. | 347/47 |
| 5,482,660 | 1/1996 | Yamamoto et al. | 347/45 |

*Primary Examiner*—Benjamin R. Fuller
*Assistant Examiner*—Christina Annick

[57] ABSTRACT

A nozzle plate for ink jet cartridges which are manufactured from a relatively thin film of material, such as, for example, polyimide, polyarylene ether, or composite of a number of materials deposited on a rigid substrate, such as a silicon wafer, and photolithographically processed from the rigid substrate to produce a large quantity of interconnected nozzle plates which may be removed as a sheet of interconnected nozzle plates for ease of handling. The nozzle plates are aligned and bonded to the nozzle bearing front faces of the cartridges.

17 Claims, 7 Drawing Sheets

NOZZLE PLATES FOR INK JET CARTRIDGES

BACKGROUND OF THE INVENTION

This invention relates to ink jet printheads and more particularly to nozzle plates for ink jet printheads and method of fabrication thereof.

As the ink jet industry moves to ink jet printheads having higher printing resolution, such as 600 dots per inch or more, a primary limit on image quality will come from errors in the direction that the droplets take when they leave the printhead nozzles. The droplet direction and error therein is referred to as directionality. Directionality problems may be incurred from several sources, such as the nozzle shapes, surface energy of the nozzle face, and ink that collects on a nozzle face near a nozzle to name a few examples. One solution to this problem is to use a nozzle plate. Other advantages of nozzle plates are that the maintenance station has a uniform surface to seal against and to clean.

Because of the small area of a printhead nozzle, especially for high resolution printheads where the sizes are in the range of 0.0332 $cm^2$ per nozzle, nozzle openings in a typical polymeric nozzle plate are so small that they are generally produced by laser ablation. Such laser ablation processes can not only be time consuming and expensive, but also produce debris or artifacts which must be collected and/or controlled to prevent entry into the printhead, for example.

SUMMARY OF THE INVENTION

It is an object of the present invention to provide a nozzle plate which may be manufactured using a batch photolithographic process to produce the orifices or nozzles in the nozzle plates. There are a large number of materials that can be deposited as thin films and then patterned using standard microelectonic lithographic techniques and processing such as polymers, metals, oxides, and nitrides. These materials can be used individually or as layered composites to form nozzle plates.

In one aspect of the present invention, there is provided a method of producing a nozzle-containing front face of an ink jet cartridge having an array of droplet emitting nozzles therein, comprising the steps of: providing a layer of photopatternable, ink resistant material on a rigid substrate, said layer of ink resistant material having a predetermined thickness; providing a mask with a predetermined light transmitting pattern defining a plurality of nozzle plates, each having an array of orifices; lithographically patterning said layer of ink resistant material on said rigid substrate using said mask to thereby produce a patterned layer of ink resistant material defining a plurality of nozzle plates, each nozzle plate having interconnected corners and an array of orifices therein equal in number and spacing to the nozzles in the array of nozzles in said nozzle-containing face of the cartridge; removing the patterned layer of ink resistant material from the rigid substrate as a sheet of interconnected nozzle plates; and bonding at least one of the plurality of nozzle plates from said interconnected sheet of nozzle plates to the cartridge face with the array of orifices in the nozzle plate being in alignment with the nozzles in the cartridge face.

In another aspect of the invention, there is provided a method of producing and installing a polymeric nozzle plate on a nozzle-containing face of an ink jet printhead having an array of nozzles therein, comprising the steps of: spin coating a photopatternable, ink resistant, film-forming polymeric material on a rigid substrate; drying the polymeric material into a film layer having a predetermined thickness; providing a mask with a predetermined light transmitting pattern defining a plurality of nozzle plates; exposing the film layer of polymeric material on said substrate to light through said mask; developing the exposed film layer of polymeric material to remove unexposed portions thereof and thereby produce a patterned film layer of polymeric material defining a plurality of nozzle plates, each nozzle plate having interconnected corners and an array of orifices therein equal in number and spacing to the nozzles in the array of nozzles in said nozzle-containing face of said printhead; curing the patterned film layer of polymeric material; and bonding one of the plurality of nozzle plates to the printhead face with the array of orifices in the nozzle plate being In alignment with the nozzles in the printhead face.

In yet another aspect of the invention, there is provided a printhead of the type having a channel plate with an ink reservoir and an array of channels open on one end and in communication with the reservoir at the other end, a heater plate having on one surface thereof an array of heating elements and addressing electrodes to individually apply electrical pulses to the heating elements, and a patterned polymeric thick film sandwiched between, the open ends of the channels serving as droplet emitting nozzles which lie in a planar face of the printhead, the printhead comprising: a photolithographically patterned nozzle plate bonded to the printhead face, the nozzle plate having an equal number of orifices with equal spacing as the printhead nozzles and aligned therewith, a plurality of nozzle plates being fabricated by spin coating a photopatternable, ink resistant, film-forming polymeric material on a rigid substrate, drying the polymeric material into a film layer having a predetermined thickness, exposing the film layer of polymeric material through a mask and developing the exposed film layer to remove the unexposed portions and form a plurality of nozzle plates having interconnected corners and said orifices, and curing the plurality of nozzle plates prior to aligning and bonding a one of the nozzle plates to the printhead face.

In one embodiment, each nozzle plate is aligned and bonded to respective printhead faces while the nozzle plates are still on the rigid substrate with interconnected corners. The amount of material which interconnects the nozzle plate corners is so small that the nozzle plates easily break from one another after the nozzle plates are removed from the substrate on which they are made. A release layer could optionally be added to the rigid substrate surface containing the film layer of polymeric material to aid in removal to the nozzle plates.

In another embodiment, the surface of the rigid substrate on which the film layer of material is to be produced could employ raised parallel surface portions dimensioned to contain the orifices of each of the nozzle plates, so that the portions of the nozzle plates containing the orifices are thinner than the remainder of the nozzle plate thereby providing that the nozzle plate orifices are recessed when installed on the printhead faces.

In yet another embodiment, the photopatternable material deposited on the rigid substrate is metal, and then patterned to produce the plurality of nozzle plates connected at their corners.

The present invention will now be described by way of example with reference to the accompanying drawings, wherein like reference numerals refer to like elements, and in which.

DESCRIPTION OF THE PREFERRED EMBODIMENT

Figure 1:
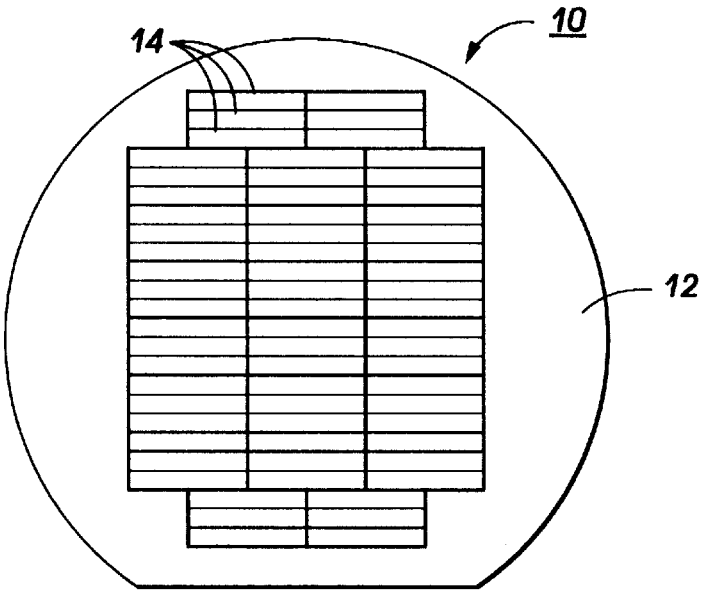
FIG. 1 is a plan view of a rigid substrate containing the photolithographically patterned polymeric nozzle plates of the present invention.
Figure 2:
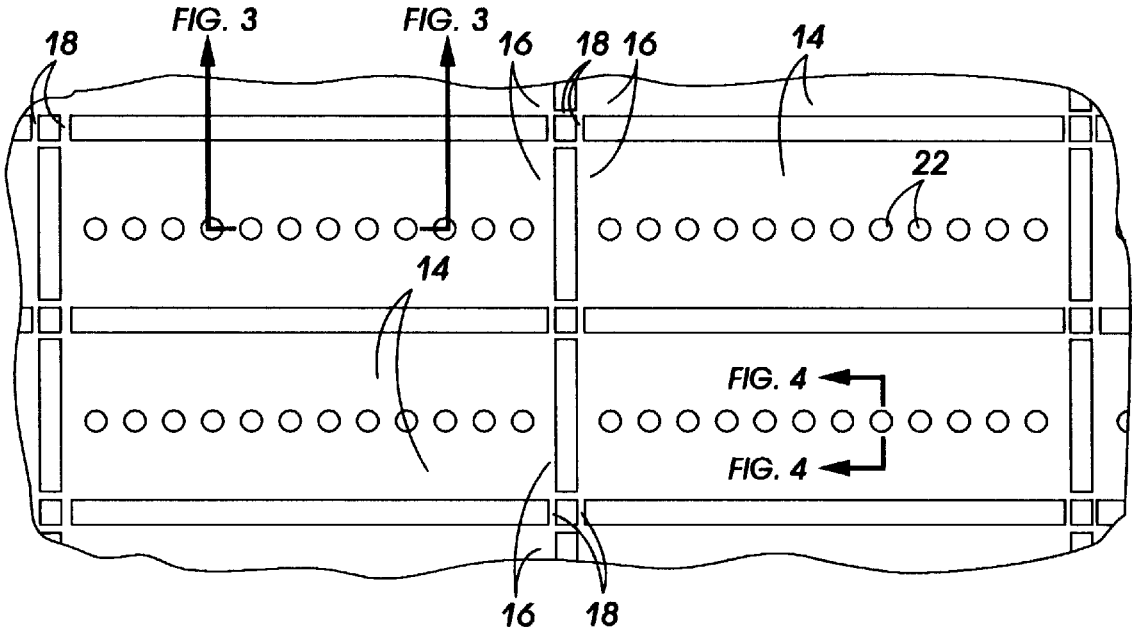
FIG. 2 is an enlarged schematic plan view of a portion of FIG. 1 showing some of the plurality of nozzle plates with each nozzle plate having an array of orifices and being interconnected at each corner thereof.

In FIG. 1, a rigid substrate 10, such as, for example, a silicon wafer, is shown in plan view with the upper surface having thereon a film or layer 12 of photopatternable material, such as suitable polymers, metals, oxides, nitrides, and layered composites thereof, which has been photolithographically patterned to produce a plurality of nozzle plates 14. An enlarged schematic plan view of a portion of FIG. 1 is shown in FIG. 2, wherein a few of the nozzle plates are shown having an array of orifices 22 and with their corners 16 joined by interconnecting nozzle plate material 18 which has been left by the design of the mask (not shown) used in the photolithographic process to pattern the nozzle plates. The joined corners provide sufficient robustness to the patterned nozzle plates to prevent undesired premature separation of the connected nozzle plates into a plurality of individual nozzle plates, but are readily broken apart with relatively light force. Thus, a large number of nozzle plates can be processed at one time, and the joined corners 16 of the nozzle plates allow a number of nozzle plates to be handled at one time. The small amount of polymeric material joining the nozzle plates is so small that they can be separated without risk of endangering the critical orifice features. Generally the connecting width of material joining the nozzle plate corners is about 10 to 20 mils (0.25 to 0.50 mm). Though only a few of orifices are shown in each nozzle plate for clarity, an actual nozzle plate would have orifices spaced at 300 or more per inch. The material removed by the photolithographic process to produce the nozzle plates exposes the underlying surface of the rigid substrate 10.

Figure 11:
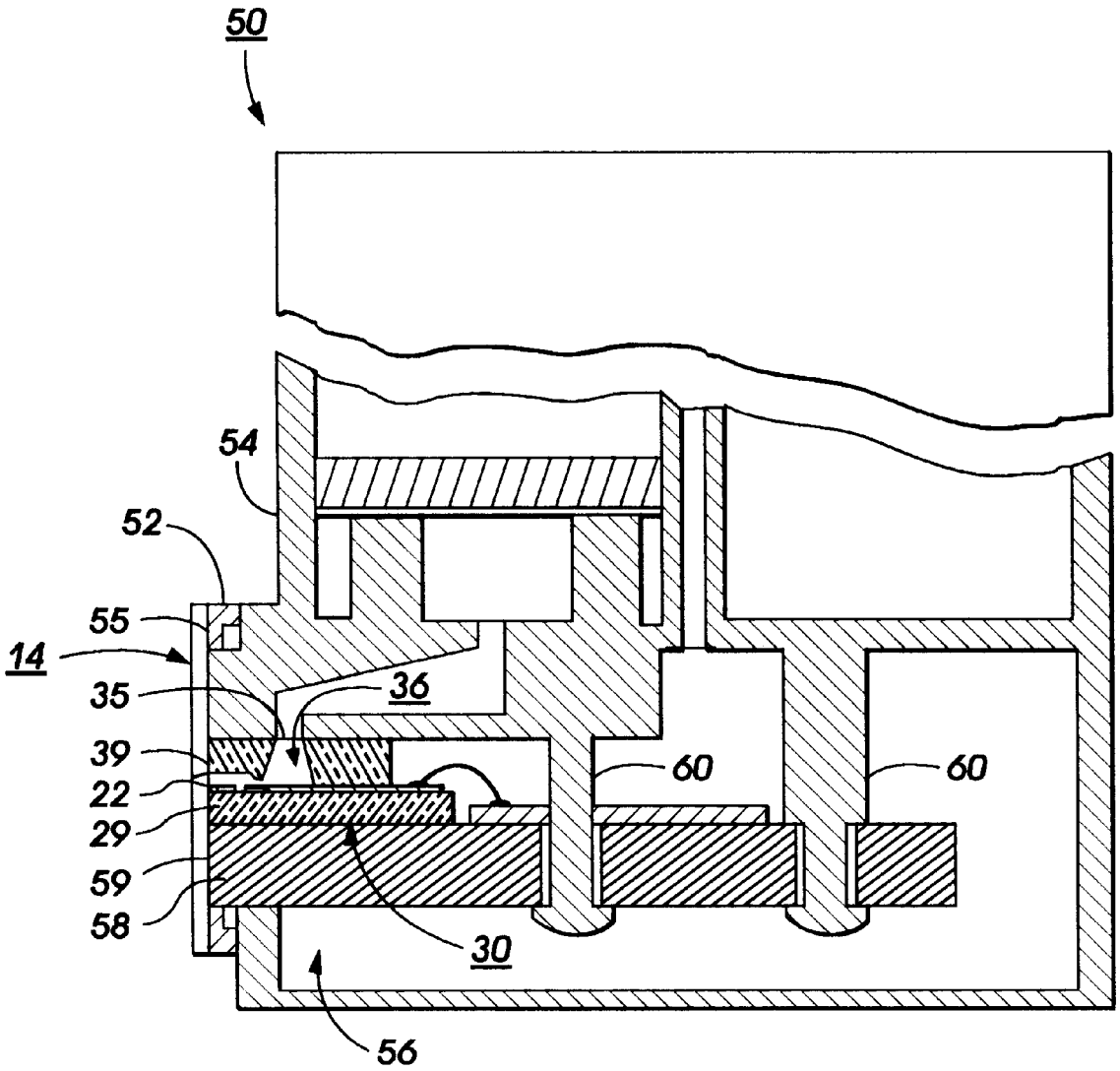
FIG. 11 is a schematic elevation view of an ink jet cartridge with an integral printhead which is partially sectioned to show the printhead and nozzle plate of the present invention.

For the preferred embodiment, a polymeric material, such as polyarylene ether, is spin coated on a silicon wafer 10 (FIG. 1) by a spin coater (not shown) to form a layer or film of polymeric material 12 which is dried to a thickness of about 10 to 100 $\mu$m, and preferably a thickness of about 20 to 50 $\mu$m, The layer of polymeric material is exposed to light through a mask (not shown) with a predetermined light transmitting pattern which defines a plurality of nozzle plates. The exposed layer of polymeric material is developed to remove the unexposed portions and produce a patterned layer of polymeric material that contains a plurality of nozzle plates 14, each of which is interconnected at the corners thereof, as shown in FIG. 2. Each nozzle plate 14 has an array of orifices 22 equal in number and spacing to the nozzles 39 in the printhead 30 (FIG. 5) on an ink jet cartridge 50 (FIG. 11). The patterned polymeric layer of interconnected nozzle plates are cured and a layer of adhesive 70 is applied (see FIGS. 3 and 4). The interconnected nozzle plates are removed from the silicon wafer as a single sheet. At least one of the plurality of nozzle plates are bonded to the front face of the ink jet cartridge with the nozzle plate orifices aligned with the nozzles of the cartridge. In an alternate embodiment, multiple interconnected nozzles are simultaneously bonded to a like number of ink jet cartridge front faces. The layer of adhesive 70 is deposited on the sheet of interconnected nozzle plates before removal from the wafer, and may optionally contain an adhesion promoter or the adhesion promoter may be optionally added as a separate layer (not shown) on the adhesive layer 70. The adhesive layer is uniformly deposited on the sheet of interconnected nozzle plates by means well known in the art with a uniform thickness of about 1 to 5 $\mu$m. One suitable adhesive application technique is disclosed in U.S. Pat. No. 4,678,529, incorporated herein by reference.

For alternate embodiments in which the ink resistant material is a metal, the deposition of the metal on the silicon wafer may be accomplished by any known means, such as, for example, by electroforming or sputtering. The metal layer is patterned using standard microelectronic lithography.

Figure 3:
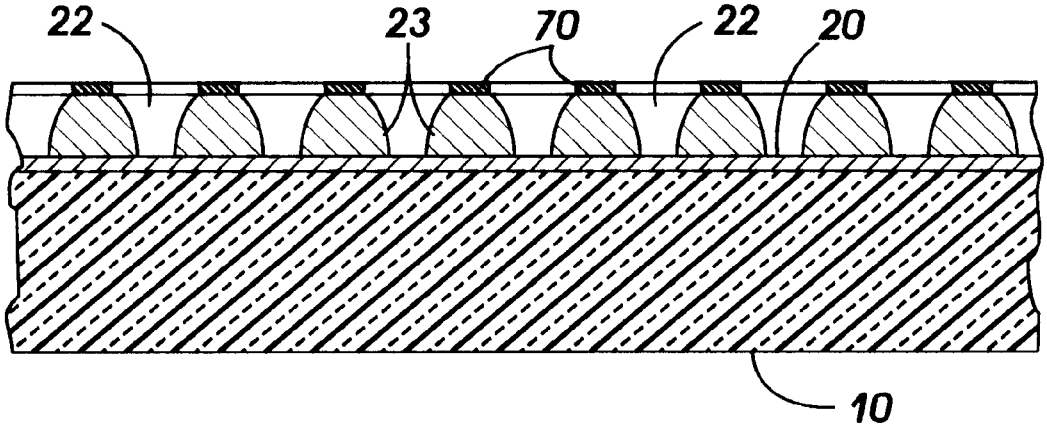
FIG. 3 is a cross-sectional view of a portion of a nozzle plate on the rigid substrate as viewed along line 3—3 of FIG. 2.

In FIG. 3, a cross-sectional view along the length of the array of orifices is shown as depicted by view line 3—3 in FIG. 2. In this cross-sectional view, the patterned orifices 22 show that the side walls 23 of the orifices are slightly inclined from the vertical with respect to the surface of the rigid substrate. Also shown, is an optional release layer 20 to assist in the removal of the nozzle plates. One convenient release layer is a silicon oxide which tends to form naturally in air, or the silicon oxide layer may be specifically grown to predetermined thicknesses in an oxygen atmosphere by means well known in semiconductor industry. One suitable depth of release layer is 20 Å to 10 $\mu$m.

Figure 4:
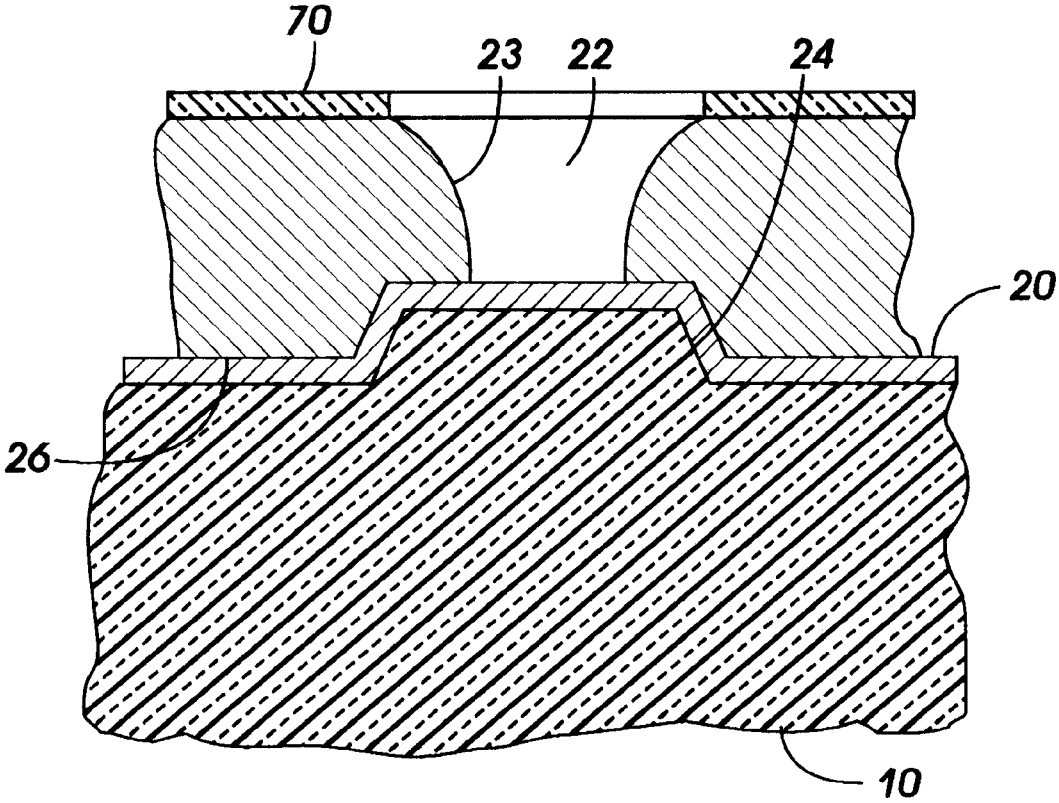
FIG. 4 is a cross-sectional view of an alternate embodiment of the invention showing the nozzle plate on a rigid substrate having raised portions on the surface thereof as viewed along line 4—4 of FIG. 2.
Figure 9:
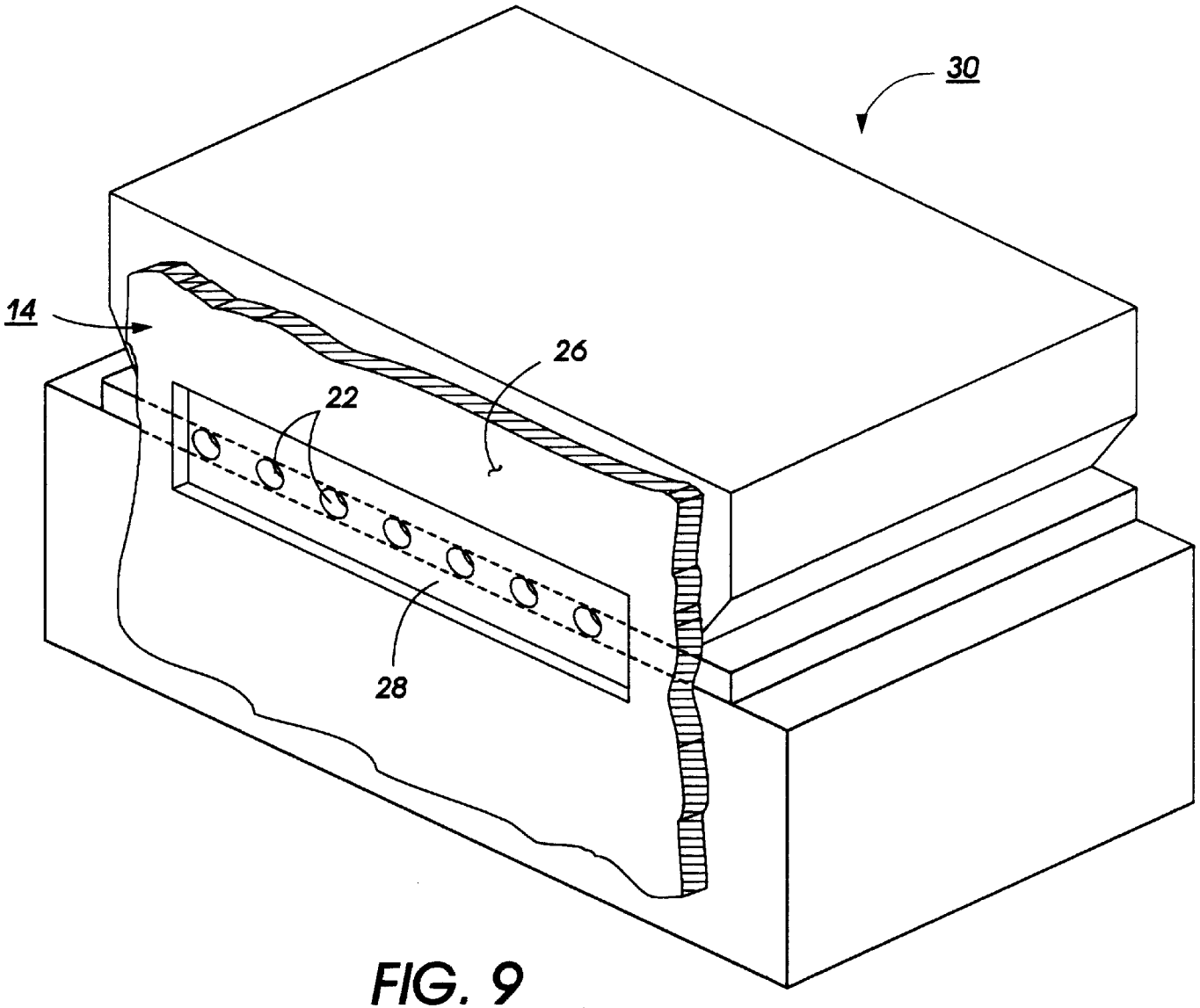
FIG. 9 is an enlarged schematic isometric view of an ink jet printhead shown in dashed line and having an alternate embodiment of the nozzle plate.

An alternate embodiment of the nozzle plate configuration is shown in FIG. 4, a cross-sectional view as viewed along view line 4—4 of FIG. 2, wherein the surface of the rigid substrate 10 has been etched, for example, to form lineal coplanar raised features or plateaus 24 in the vicinity of the array of orifices 22. Alternately, the raised areas can be formed by depositing a raised layer directly on the rigid substrate. The raised features 24 on the surface of the rigid substrate produces nozzle plates 14 having orifices 22 recessed from the nozzle plate exterior surface 26 in recesses 28, as also shown in FIG. 9. One advantage of this nozzle plate configuration is that cleaning operations, such as by cleaning blades, do not touch the orifices themselves. Another is that the nozzle plate can be thick enough for convenient handling and bonding, while the thickness in the vicinity of the orifices is kept small for efficient operation of the printhead. The typical depth of a recess 28 or the height of a raised feature on the surface of a rigid substrate is in the range of 5 to 50 $\mu$m.

Figure 5:
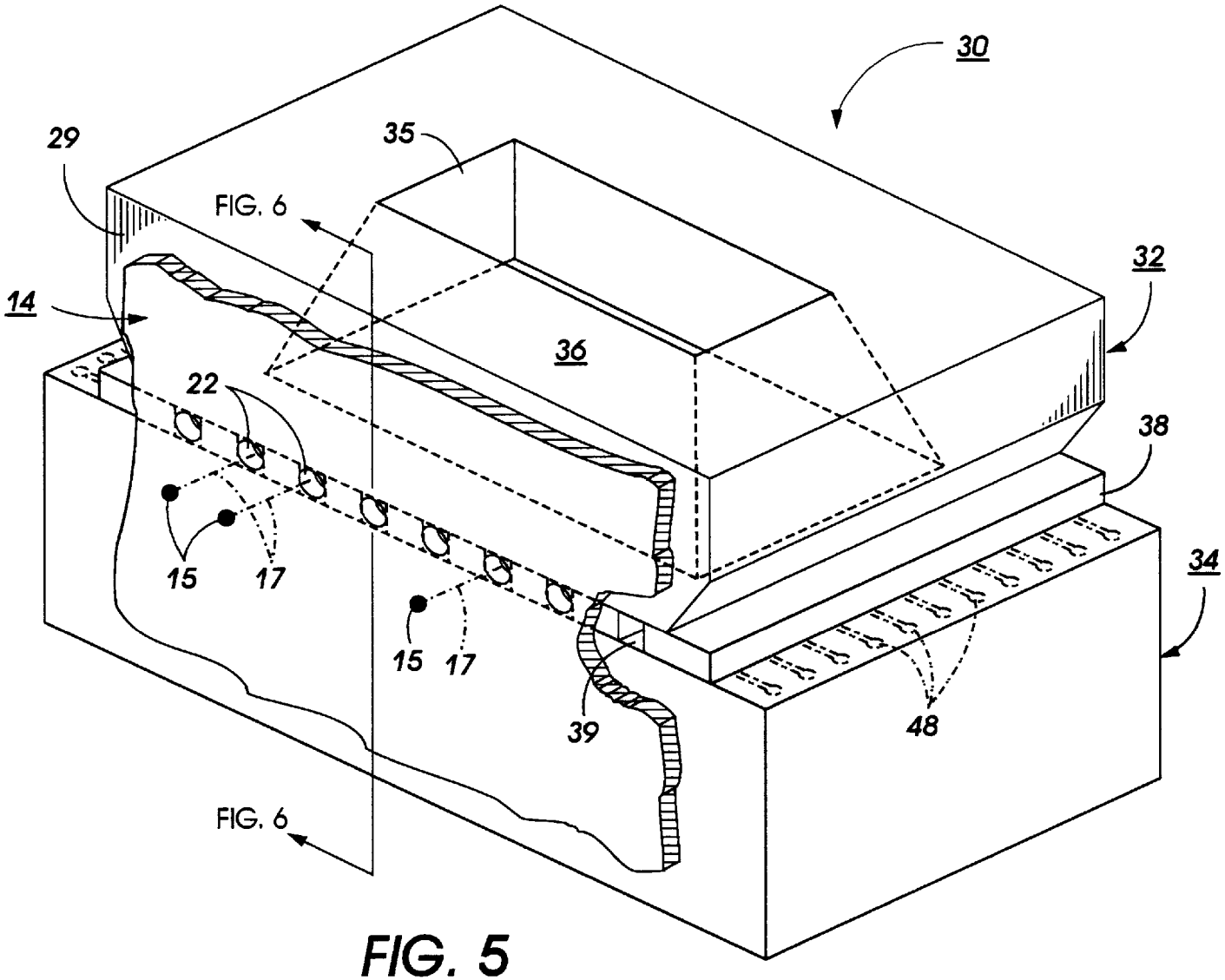
FIG. 5 is an enlarged schematic isometric view of an ink jet printhead having the nozzle plate of the present invention aligned and bonded on the printhead face.
Figure 6:
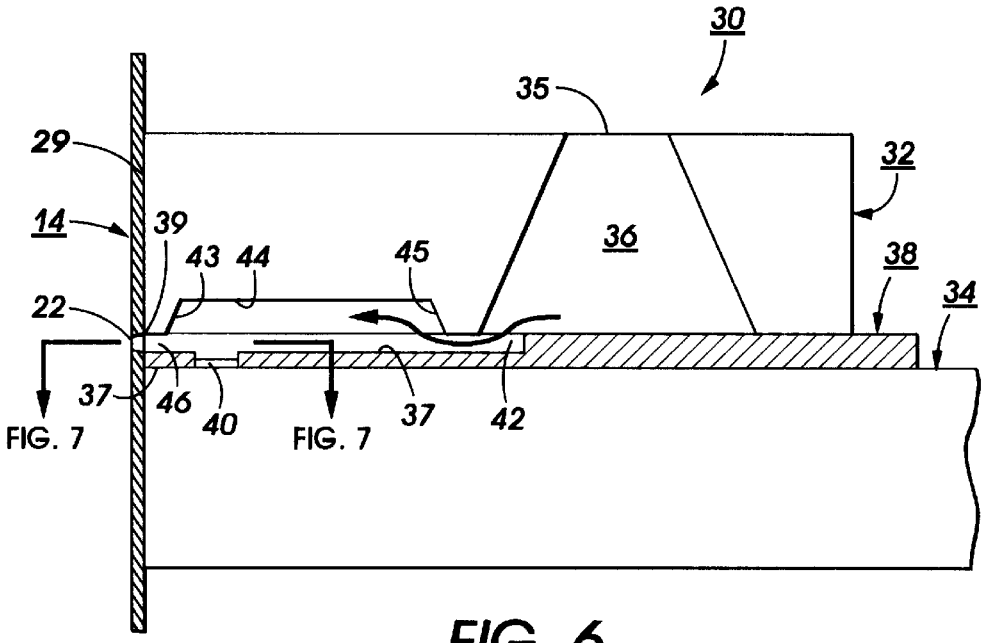
FIG. 6 is a cross-sectional view of the printhead as viewed along view line 6—6 of FIG. 5.
Figure 10:
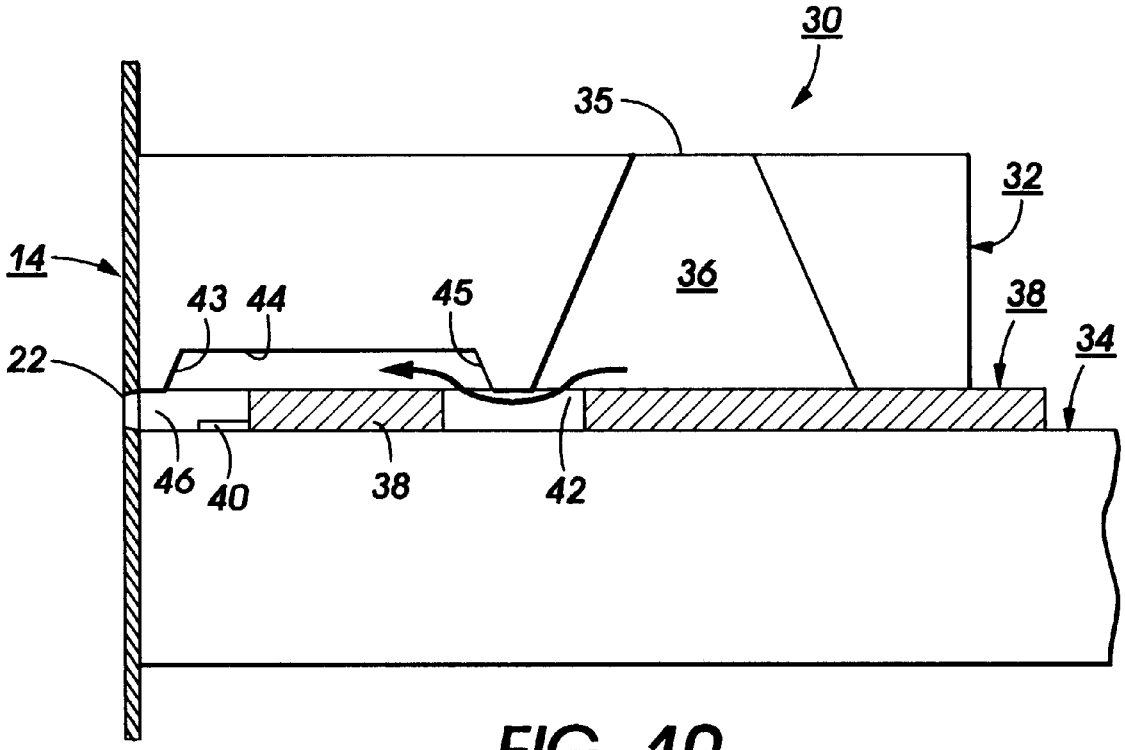
FIG. 10 is a partial shown cross-sectional view of an alternate embodiment of the printhead shown in FIG. 6.

Referring to FIG. 5, a thermal ink jet printhead 30 is shown comprising a channel plate 32 with an ink reservoir 36 shown in dashed line and an ink inlet 35 and a heater plate 34 having a patterned thick film layer 38 thereon. The thick film layer is sandwiched between the channel and heater plates as disclosed in U.S. Pat. No. 4,774,530 which patent is incorporated herein by reference. In the '530 patent, the ink channels are anisotropically etched so that they have triangular cross-sections. In one embodiment (not shown), one end of channels penetrate the front face of the printhead and thereby provide triangular shaped nozzles. Though not shown, the nozzle plate 14 of the present invention would be bonded to the printhead front face with the orifices therein in alignment with the triangular nozzles, so that the nozzle plate orifices change to the shape of the printhead nozzles to the shape of the nozzle plate orifices. The printhead shown in FIG. 5 is different from the printhead described in U.S. Pat. No. 4,774,530 in that the etched channels are closed at both ends and the thick film layer is patterned to provide a flow path from the heating element 40 to the printhead front face 29 as shown in FIGS. 6 and 10 and disclosed in U.S. Pat. No. 4,994,826, also incorporated herein by reference. Using the patterned thick film layer to provide the printhead nozzles changes the shape of the droplet emitting nozzles from triangular to rectangular shapes. As shown in FIG. 11, discussed later, the nozzle plate 14 of the present invention is dimensioned to cover the entire surface of cartridge face plate 52 of the ink cartridge 50 when it is aligned and bonded thereto using the adhesive layer 70 on the nozzle plate, so that the nozzle plate orifices 22 are aligned with and cover the nozzles 39 in the front face 29 of the printhead 30. For a typical ink cartridge having a face plate surface which is coplanar with the printhead front face, refer to U.S. Pat. No. 5,519,425, incorporated herein by reference. The thick film layer 38 of printhead 30 may optionally be the same material as the nozzle plate. Any suitable photopatternable, film forming polymeric material which is ink resistant and has sufficient mechanical integrity may be used for the nozzle plate, such as, for example, polyimides or polyarylene ether (PAE) more generically described in co-pending patent application Ser. No. 08/705,375 entitled "CURABLE COMPOSITIONS" filed Aug. 29, 1996 and assigned to the same assignee as the present invention. Patent application Ser. No. 08/705,375 is incorporated herein by reference. Other suitable nozzle materials are thin metal films, metalized polymeric films, oxide metal composites, and benzocyclobutenes.

In FIG. 6, a cross-sectional view of the printhead is shown as viewed along view line 6—6 of the printhead of FIG. 5. In this configuration, the thick film layer 38 is patterned to provide a thin film layer 37 of same or similar material at the bottom of a first trench 46 extending from each heating element 40 to the front face 29 of the printhead. A second trench 42 in the thick film layer 38 has the same thin film layer 37 extending between the heating element to a location beyond the channel end 45 adjacent the reservoir 36. Thus, the first trench 46 starts at the heating element 40 and ends at the front face 29, penetrating same as nozzle 39. The second trench 42 places the channels 44 into fluid communication with the reservoir. The etched channels 44 are closed at both ends, one end 45 adjacent the reservoir and the opposite end 43 adjacent but spaced from the front face 29. The heating element 40 is located between the first and second trenches in a pit located a predetermined distance from the printhead front face 29. In one embodiment, the thick film layer 38 is a composite of two different layers of polymeric material, such as polyimide, one layer being the thin film layer 37. For illustration, ink droplets 15 are shown in FIG. 5 following trajectories 17 after ejection from the orifices 22 of the printhead nozzle plate 14. The channel plate 32 is permanently bonded to the patterned thick film layer 38 on the heater plate 34. The channel plate is anisotropically etched, also referred to as orientation dependent etching (ODE), from one surface thereof to produce the ink reservoir 36 and the channels 44 as disclosed in U.S. Pat. No. 4,994,826, mentioned above. The heater plate 34 contains on one surface thereof a plurality of heating elements 40 with addressing electrodes 48, shown only in FIG. 5 in dashed line, which enable the heating elements to be selectively addressed with electrical pulses to momentarily produce the ink vapor bubbles which expel the ink droplets. As disclosed in U.S. Pat. No. 4,774,530, the channel and heater plates are mass produced respectively in channel and heater wafers. Once the channel and heater wafers are mated, they are diced into a plurality of individual printheads 30.

An alternate embodiment is shown in FIG. 10, which differs from FIG. 6 in that the thick film layer is patterned to remove the thick film layer 38 from above each heating element 40 to the front face 29 of the printhead and between the channel end 45 adjacent the reservoir 36 and the reservoir, thereby forming a first trench 46 which starts at the heating element 40 and ends at the front face 29, penetrating same as nozzles 39, and forming a second trench 42 which places the channels into fluid communication with the reservoir.

Figure 7:
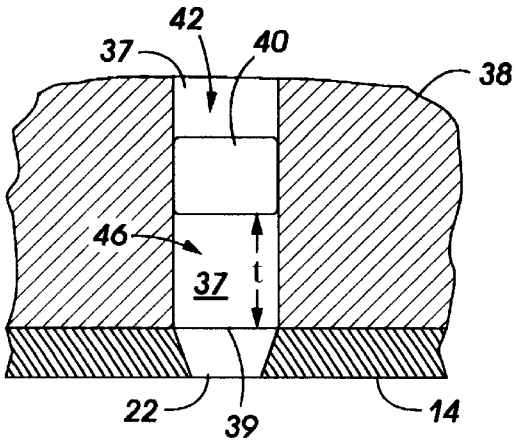
FIG. 7 is a partially shown plan view of the heater plate and showing the patterned thick film layer for one heating element and showing the orifice of the nozzle plate in cross-sectional view as viewed along view line 7—7 of FIG. 6.
Figure 8:
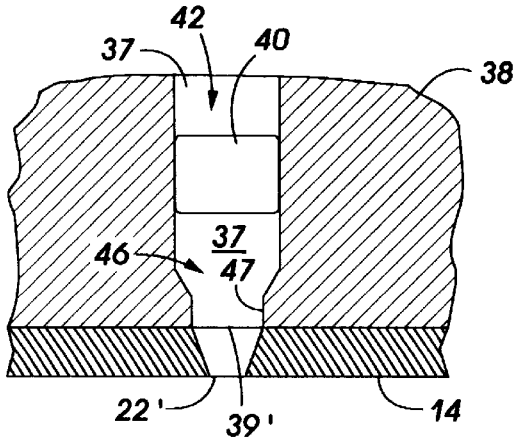
FIG. 8 is a similar view as FIG. 7 but showing an alternate embodiment of the patterned thick film layer for the heating element.

FIG. 7 is a partially shown plan view of the heater plate 34 as viewed along view line 7—7 of FIG. 6. This view shows the first and second trenches 46, 42 patterned in the thick film layer 38 with the heating element in a pit at a predetermined distance "t" from nozzle 39 which is aligned with orifice 22 of nozzle plate 14. The bottom of the first and second trenches are covered with the thin film layer 37. As depicted and explained above with respect to FIGS. 3 and 4, the nozzle plate orifices have inclined walls relative to the nozzle plate surfaces, so that the exterior portion of the orifice is the most narrow portion for better providing directionality of the emitted ink droplets. FIG. 8 is another embodiment of the first and second trenches 46, 42 of FIG. 7. In FIG. 8, the first trench 46 has a different shape; viz., the portion 47 adjacent the front face 29 is tapered to narrow the trench 46 to the size or width of smaller orifices 22 producing smaller nozzles 39.

Referring to FIG. 11, the nozzle plate 14 is shown having a dimension similar in size to the face plate 52 of the cartridge 50. The cartridge face plate has an opening which accepts a portion of the cartridge housing 54 on which the printhead assembly 56 comprising printhead 30 and heat sink 58 are attached by housing stake pins 60 which are swaged or staked to permanently attach the printhead assembly to the cartridge as disclosed and more fully described in U.S. Pat. No. 5,519,425, incorporated herein by reference. The printhead front face 29, an edge 59 of the heat sink, and the surface 55 of the picture frame shaped cartridge face plate are all substantially coplanar. The nozzle plate 14 is bonded to the entire face plate 52 using the adhesive layer 70 thereon and coplanar surfaces of the printhead assembly with the nozzle plate orifices 22 being aligned with the printhead nozzles 39.

There are many techniques to align and bond the nozzle plates 14 with the cartridge face plates 52 so that each array of nozzle plate orifices 22 are aligned into the printhead nozzles 39, and any suitable technique will suffice. For example, the plurality of nozzle plates could be removed from the rigid substrate as a sheet for ease of handling and then placed on a reel tape (not shown) for automatic alignment and bonding to the cartridge face plates by an assembly fixture (not shown).

As mentioned above, a release layer 20 may be used to assist in peeling the sheet of nozzle plates from the rigid substrate 10. The small amount of nozzle plate material 18 which connects the nozzle plate corners 16 keep the plurality of nozzle plates together as a sheet, but easily fracture without damaging the nozzle plate in the vicinity of the orifices 22 when individual nozzle plates are desired.

Alternatively, the plurality of nozzle plates could be removed from the rigid substrate as a single patterned sheet of interconnected nozzle plates, and a one of the nozzle plates thereof could be aligned and bonded to a single printhead front face, using the adhesive layer 70 and optionally an adhesive promoter, by use of an assembly tool (not shown)or manually with aid of a typical magnifying glass or microscope. Again, the small amount of interconnecting nozzle plate material 18 which joins the nozzle plate corners 16 easily breaks without damage to the other nozzle plates in the sheet or the one bonded to the printhead front face. The interconnected corners of the nozzle plates, however, provide enough robustness to the sheet of nozzle plates to prevent the nozzle plates from inadvertent separation. In another assembly technique, individual nozzle plates could be separated from the sheet of patterned nozzle plates and individually aligned and bonded to the printhead front faces manually with a magnifying glass or microscope or by assembly tool such as a small vacuum pickup probe (not shown).

In one embodiment, the sheet of interconnected nozzle plates could be applied to a plurality of ink jet cartridges simultaneously. The cartridges (not shown) are arranged in rows and/or columns, so that multiple nozzle plates can be aligned over the cartridge front faces, while the nozzle plates are still interconnected at their corners. The connected nozzle plates are lowered into bonding contact with the cartridge faces with the nozzle plate orifices aligned with the cartridge nozzles. After bonding, the removal of the cartridges breaks the interconnecting material between nozzle plates without damage thereto.

In another embodiment, the sheet of interconnected nozzle plates are applied to a plurality of ink jet printheads simultaneously. The printheads (not shown) are arranged in rows and/or columns, so that multiple nozzle plates can be aligned over the printhead faces containing the nozzles, while the nozzle plates are still interconnected at their corners. The connected nozzle plates are lowered into bonding contact with the printhead faces with the nozzle plate orifices aligned with the printhead nozzles. After bonding, the printheads are moved to break the interconnecting material between the nozzle plates without changing the bonded nozzle plates in the vicinity of the orifices.

In one embodiment, when silicon wafers are used as the rigid substrate, it was found that the patterned PAE films could be removed or peeled without difficulty or damage to the nozzle plates whether they were removed individually or as a sheet of many nozzle plates, if the PAE films were cured in air and no adhesion promoter was used. This ease of removal was determined to be aided by the naturally occurring silicon oxide layer on the wafer, and the thicker the silicon oxide layer the easier the PAE films peeled from the wafer. One difficulty encountered was the inadvertent lifting off of the PAE film during the photolithographic patterning of the nozzle plates in the PAE. This problem was solved in one embodiment by applying an adhesion promoter and etching away the silicon oxide, so that the silicon oxide layer is used as a sacrificial layer in the nozzle plate fabrication process. Another solution was to use an adhesion promoter that could be attacked by a solvent to assist in removal of the patterned PAE film. In the preferred embodiment, it was found that ordinary care in handling the wafer with the patterned PAE generally kept the PAE from separation from the wafer having only the naturally occurring silicon oxide layer and a high yield of sheets of patterned nozzle plates was maintained.

The ability to appropriately bond the nozzle plates to the front face to the printheads is increased when the thick film layer on the heater plate is also the same material as the nozzle plate, for most materials tend to prefer to self-adhere when the nozzle plate is mated with the printhead front face. Therefore, less adhesive with or without an adhesion promoter is necessary when both the printhead's thick film layer and the nozzle plate are the same, so an adhesive is generally only required for the frame shaped cartridge face plate.

Although the foregoing description illustrates the preferred embodiment, other variations are possible and all such variations as will be apparent to those skilled in the art are intended to be included within the scope of this invention as defined by the following claims. For example, nozzle plates for cartridges which have roof shooter type printheads would be fabricated and mounted thereon is the same or analogous way.

We claim:

1. A method of producing a nozzle plate for a nozzle-containing front face of an ink jet cartridge having an array of droplet emitting nozzles therein, comprising the steps of:

(a) providing a layer of photopatternable, ink resistant material on an upper surface of a rigid substrate said upper surface having a release layer and, said material layer having a thickness of about 10 to 100 $\mu$m;

(b) providing a mask with a light transmitting pattern defining a plurality of nozzle plates, each having an array of orifices;

(c) photolithographically patterning said layer of ink resistant material on said substrate using said mask to thereby produce a patterned layer of ink resistant material defining a plurality of nozzle plates, each nozzle plate having interconnected corners with adjacent nozzle plates and an array of orifices in a portion thereof, the array of orifices being equal in number and spacing to the nozzles in the array of nozzles in said nozzle-containing face of said cartridge;

(d) removing the patterned layer of ink resistant material from the rigid substrate as a sheet of interconnected nozzle plates; and (e) bonding at least one of the plurality of nozzle plates from said interconnected sheet of nozzle plates to the cartridge face with the array of orifices in the nozzle plate being In alignment with the nozzles in the cartridge face.

2. The method as claimed in claim 1, wherein the ink resistant material is any suitable film-forming polymeric material; and wherein the layer of ink resistant material has a thickness of about 20 to 50 $\mu$m.

3. The method as claimed in claim 2, wherein ink resistant material is solvent resistant.

4. The method as claimed in claim 3, wherein the ink resistant material is polyarylene ether or benzocyclobutene.

5. The method as claimed in claim 1, wherein the layer of ink resistant material is a metal.

6. The method as claimed in claim 1, wherein the ink resistant material is a suitable metalized polymeric film.

7. The method as claimed in claim 1, wherein the rigid substrate is a silicon wafer; and wherein the release layer is an oxide layer; which acts as a release layer for the interconnected sheet of nozzle plates.

8. The method as claimed in claim 7, wherein the interconnected corners of the nozzle plates are connected by a width of ink resistant material which is so small as to enable individual nozzle plates to be broken therefrom without damage to the portion of nozzle plates containing the orifice arrays and concurrently be sufficient to provide the robustness necessary to keep the sheet of interconnected nozzle plates intact without inadvertent separation.

9. The method as claimed in claim 1, wherein the rigid substrate is a silicon wafer with an upper surface having raised parallel surface portions which are coplanar and dimensioned to contain the orifices of each of the nozzle plates, so that the portions of the nozzle plates containing the orifices are thinner than the remainder of the nozzle plates, thereby providing that the nozzle plate orifices are recessed.

10. The method as claimed in claim 1, wherein the layer of ink resistant material defining a plurality of nozzle plates is a composite of two or more layers.

11. The method as claimed in claim 1, wherein the method further comprises the step of depositing an adhesion layer on the patterned layer of ink resistant material which define the plurality of nozzle plates prior to step (d).

12. The method as claimed in claim 1, wherein the method further comprises the steps of:

(g) providing the layer of photopatternable, ink resistant material at step (a) by spin coating a film forming polymeric material on said rigid substrate;

(h) drying the polymeric material into a layer of film having a thickness of about 10 to 50 $\mu$m;

(i) photolithographically patterning the layer of polymeric material at step (c) by exposing the film layer to light through said mask provided at step (b), thereby providing exposed and unexposed portions thereof;

(j) developing the exposed portions of the layer of polymeric material and removing the unexposed portions thereof in order to produce said patterned layer of ink resistant material defining said plurality of nozzle plates having interconnected corners; and (k) at least partially curing the patterned layer of polymeric material prior to step (d).

13. The method as claimed in claim 12, wherein the film-forming polymeric material is polyarylene ether (PAE).

14. The method as claimed in claim 12, wherein the film-forming polymeric material is benzocyclobutene.

15. The method as claimed in claim 12, wherein the rigid substrate is a silicon wafer with an upper surface; and wherein the upper surface of the wafer has an oxide layer which acts as a release layer for the film-forming polymeric material coated thereon.

16. A method of producing a nozzle plate for a nozzle-containing front face of an ink jet printhead having an array of droplet emitting nozzles therein, comprising the steps of:

(a) providing a layer of photopatternable, ink resistant material on a rigid substrate said upper surface having a release layer and, said material layer having a thickness of about 10 to 100 $\mu$m;

(b) providing a mask with a light transmitting pattern defining a plurality of nozzle plates, each having an array of orifices;

(c) photolithographically patterning said layer of ink resistant material on said substrate using said mask to thereby produce a patterned layer of ink resistant material defining a plurality of nozzle plates, each nozzle plate having interconnected corners between adjacent nozzle plates and an array of orifices in a portion of each nozzle plate, the orifices in each orifice array being equal in number and spacing to the nozzles in the array of nozzles in said nozzle-containing face of said printhead;

(d) removing the patterned layer of ink resistant material from the rigid substrate as a sheet of interconnected nozzle plates; and (e) bonding at least some of the plurality of nozzle plates from said interconnected sheet of nozzle plates to an equal number of printhead faces simultaneously with the array of orifices in each nozzle plate being in alignment with the nozzles of a respective one of the printhead faces.

17. The method as claimed in claim 8, wherein the width of interconnecting ink resistant material is about 10 to 20 mils (0.25 to 0.50 mm).

* * * * *